US007488153B2

(12) United States Patent
Reigl

(10) Patent No.: US 7,488,153 B2
(45) Date of Patent: Feb. 10, 2009

(54) STEAM TURBINE

(75) Inventor: Martin Reigl, Unterehrendingen (CH)

(73) Assignee: ALSTOM Technology Ltd., Baden (CH)

( * ) Notice: Subject to any disclaimer, the term of this patent is extended or adjusted under 35 U.S.C. 154(b) by 326 days.

(21) Appl. No.: 11/017,758

(22) Filed: Dec. 22, 2004

(65) Prior Publication Data

US 2005/0163612 A1 Jul. 28, 2005

Related U.S. Application Data

(63) Continuation of application No. PCT/CH03/00426, filed on Jun. 26, 2003.

(30) Foreign Application Priority Data

Jul. 1, 2002 (EP) ..... 02014534.8

(51) Int. Cl.
*F01D 5/08* (2006.01)

(52) U.S. Cl. ..... 415/177; 416/96 R

(58) Field of Classification Search ..... 415/100, 415/177, 220, 221; 416/96 R, 97 R, 193 A
See application file for complete search history.

(56) References Cited

U.S. PATENT DOCUMENTS 2,552,239 A * 5/1951 Warren ..... 415/112
4,405,284 A 9/1983 Albrecht et al.
4,551,063 A * 11/1985 Raschke et al. ..... 415/115
5,149,247 A 9/1992 Gros et al.
5,503,405 A * 4/1996 Jewett et al. ..... 277/413

(Continued)

FOREIGN PATENT DOCUMENTS

CH 308991 8/1955

(Continued)

OTHER PUBLICATIONS

Takamasa, M., "Steam Turbine," Patent Abstracts of Japan 1983; 007(257):M-256; Publication No. 58140403.

(Continued)

*Primary Examiner*—Edward Look
*Assistant Examiner*—Nathaniel Wiehe
(74) *Attorney, Agent, or Firm*—Adam J. Cermak; Cermak Kenealy Vaidya & Nakajima LLP

(57) ABSTRACT

A steam turbine (10) having an inner casing (11), in which a rotor (12) that can rotate about an axis (13) is arranged, a steam passage (14) being formed between the rotor (12) and the inner casing (11), in which steam passage there is a multi-stage arrangement of guide vanes (16) secured to the inner casing (12) and rotor blades (17) secured to the rotor (12), in which arrangement hot steam coming from an inlet (15) undergoes work-performing expansion. In a steam turbine of this type, the thermal loading of the rotor and/or inner casing, in particular when starting up, is reduced by virtue of the fact that at least in the steam passage (14) plate-like protective shields (18, 19, 20), which protect the surface of the rotor (12) or inner casing (11) beneath them from the direct action of the hot steam flowing through the steam passage (14), are arranged parallel and close to the surface of the rotor (12) and/or parallel and close to the inner surface of the inner casing (11).

18 Claims, 7 Drawing Sheets

U.S. PATENT DOCUMENTS

| | | | | |
|---|---|---|---|---|
| 5,524,340 | A * | 6/1996 | Galbraith et al. | 29/889.1 |
| 5,558,496 | A * | 9/1996 | Woodmansee et al. | 416/95 |
| 6,010,302 | A | 1/2000 | Oeynhausen | |
| 6,045,134 | A * | 4/2000 | Turnquist et al. | 277/347 |
| 6,341,937 | B1 | 1/2002 | Magoshi et al. | |
| 6,416,276 | B1 * | 7/2002 | Marmilic et al. | 415/178 |
| 6,783,321 | B2 * | 8/2004 | Lathrop et al. | 415/100 |

FOREIGN PATENT DOCUMENTS

| | | |
|---|---|---|
| CH | 340669 | 8/1959 |
| DE | 1 576 975 | 11/1970 |
| EP | 1 076 184 | 2/2001 |
| FR | 897716 | 3/1945 |

OTHER PUBLICATIONS

Tadashi, T., "Steam Turbine Rotor Cooling Equipment," Patent Abstracts of Japan 1985; 009(162):M-394; Publication No. 60035103.

Copy of Search Report from EP 02014534.8 (Dec. 9, 2002).

Copy of International Search Report from PCT/CH03/00426 (Sep. 12, 2003).

Copy of International Preliminary Examination Report from PCT/CH03/00426 (Feb. 11, 2004).

* cited by examiner

STEAM TURBINE

This application is a Continuation of, and claims priority under 35 U.S.C. § 120 to, International application no. PCT/CH03/00426, filed 26 Jun. 2003, and claims priority under 35 U.S.C. § 119 to EPO patent application no. 02014534.8, filed 1 Jul. 2002, the entireties of both of which are incorporated by reference herein.

BACKGROUND OF THE INVENTION

1. Field of the Invention

The present invention deals with the field of steam turbines.

2. Brief Description of the Related Art

Steam turbine rotors and inner casings, when the turbine is starting up, are subject to high thermal stresses, in particular in the region of the inlet, from the relatively hot steam flowing past them, and these stresses limit the service life of the components and the start-up time.

Therefore, various proposals have already been made in the past as to how the rotors and inner casings of steam turbines can be cooled in the critical areas without additional, external devices.

U.S. Pat. No. 4,551,063 has disclosed a medium-pressure steam turbine in which cooling steam is removed at the outlet of the high-pressure turbine prior to the reheating and is routed out of an annular space located outside the steam passage, via axial bores in the rotor, into the first two stages of the turbine, where it is fed into the steam passage from the blade roots. A solution of this type can only be employed for high-pressure turbines but not for medium-pressure turbines.

In the case of a combined high-pressure/medium-pressure steam turbine disclosed by U.S. Pat. No. 5,149,247, the stator is divided into an external stator and an internal stator, which are separated from one another by an intermediate space. For cooling purposes, cooling steam is removed from the final stage of the high-pressure part and introduced into the intermediate space. A similar solution is also disclosed in U.S. Pat. No. 6,341,937. Neither solution prevents the whole of the inner stator being exposed to the live steam.

Finally, in U.S. Pat. No. 6,010,302, the rotor is provided with a central bore through which cooling steam which has been removed at the outlet of the high-pressure stage is routed. In this solution, cooling of the inner casing is not provided and is indeed not possible.

SUMMARY OF THE INVENTION

Therefore, one aspect of the present invention includes providing a steam turbine which, with relatively simple means, allows flexible internal cooling of the rotor and/or the inner casing and thereby improves the start-up time and service life of rotor and inner casing.

One of numerous principles of the present invention concerns arranging at least in the steam passage plate-like protective shields, which protect the surface of the rotor or inner casing beneath them from the direct action of the hot steam flowing through the steam passage, the plate-like protective shield being arranged parallel and close to the surface of the rotor and/or parallel and close to the inner surface of the inner casing.

A first exemplary configuration is distinguished by the fact that the protective shields, as passive protective shields, rest directly on that surface of the rotor or the inner casing which is to be protected or are only separated from the surface to be protected by a gap. They are not actively cooled, but rather only ensure that the hot steam of the steam passage no longer flows past at a high velocity, for which reason they are referred to here as "passive" protective shields or plates. The high velocity is brought about by the rotation of the rotor and the flow of steam which is present relative to the inner casing and it intensifies the heat transfer from the hot steam to the component surface. On account of the fact that although the hot steam temperature is still active, the protective shields mean that there is no longer any relative velocity between steam and component surface, the heat transfer is significantly reduced. The protective shields may in this case be designed (on the rotor side) as part of the rotor blades secured to the rotor.

A second exemplary configuration of the invention is characterized in that the protective shields are arranged at a distance from that surface of the rotor or inner casing which is to be protected, so as to form a relatively wide intermediate space, and in that the steam turbine is designed in such a manner that cooling steam flows through the intermediate space. Exemplarily, first protective shields are arranged in the front stages, as seen in the direction of flow, of the steam passage, and the cooling steam is removed from the steam passage in one of the stages located further downstream and is fed back through the intermediate space in the opposite direction to the direction of flow.

Therefore, heated steam which is only removed from the steam passage when it has already passed through a pressure drop is used. Consequently, the steam is cooler than the steam in the inlet. This cooler steam is then diverted and passed into the intermediate spaces along the rotor surface or the casing surface to the first stages, which are acted on by the hottest steam. To ensure that the cooling or cool steam can flow in this direction, it is passed to a location at a lower pressure level. This location may, for example, be a sealing chamber in a piston or casing shaft seal or, in the case of double-flow machines, a rear stage in the second flow. However, this location may also be the exhaust steam of the machine. To ensure that no hot steam is able to flow into the cooling intermediate spaces, it is necessary for the cooling intermediate space to be sealed off with respect to the hot steam at a higher pressure. Pressure tight protective shields or plates are used for this purpose.

If in particular the steam turbine is of single-flow design, and in the region of the inlet a seal, in particular in the form of a piston or casing shaft seal, is provided between rotor and inner casing on the opposite side from the steam passage, second protective shields are arranged, for example, in the region of the seal at a distance from that surface of the rotor or inner casing which is to be protected, so as to form a relatively wide intermediate space, and the cooling steam flowing through the intermediate space behind the first protective shields is then passed through the spaces behind the second protective shields.

If in this case the first and second protective shields are intended to protect the surface of the rotor, a common intermediate space which is continuous through the region of the inlet is formed behind the first and second protective shields.

If the first and second protective shields are intended to protect the surface of the inner casing, intermediate spaces, which are connected to one another, e.g., by a passage or bore routed around the region of the inlet in the inner casing, are formed behind the first and second protective shields.

BRIEF DESCRIPTION OF THE DRAWINGS

The invention is to be explained in more detail below on the basis of exemplary embodiments in conjunction with the drawing, in which.

DETAILED DESCRIPTION OF EXEMPLARY EMBODIMENTS

Figure 1:
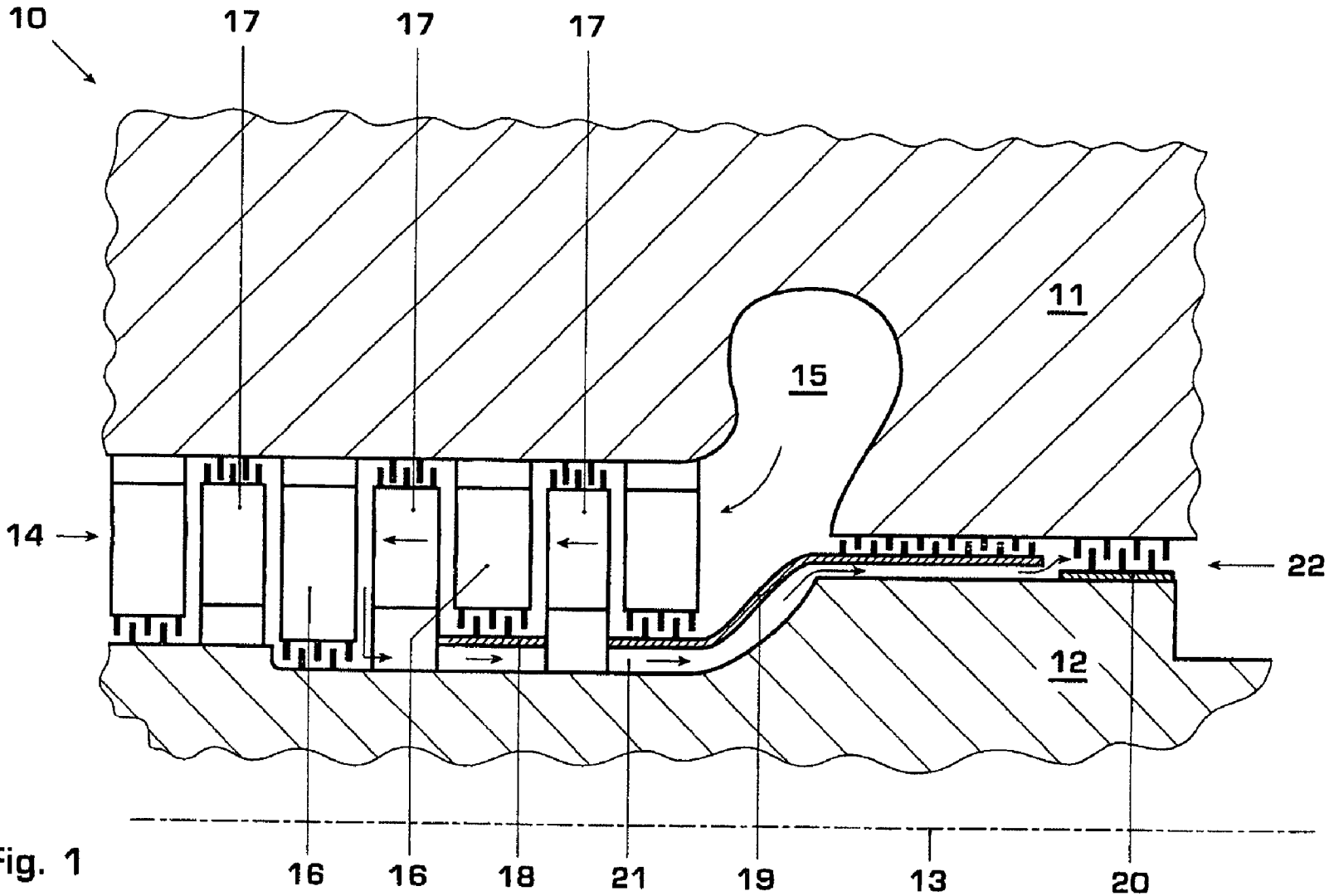
FIG. 1 shows a longitudinal section through a first exemplary embodiment of the invention with actively steam-cooled protective shields for protecting the rotor.

FIG. 1 illustrates a longitudinal section through a first exemplary embodiment of the invention with actively steam-cooled protective shields for protecting the rotor. FIG. 1 shows an arrangement for a steam turbine 10 having a single-flow inner casing 11. Hot steam flows from the inlet 15 through the steam passage 14, which is formed between the inner casing 11 and the rotor 12, which can rotate about an axis 13, of the steam turbine 10, and in which the guide vanes 16 and rotor blades 17 are located in a plurality of stages connected in series. The pressure and temperature of the steam decrease from stage to stage. In the exemplary embodiment shown, steam is removed downstream of the second stage (cf. the arrows indicated) and is passed along the surface of the rotor 12 as cooling steam, in an intermediate space 21 located beneath protective shields 18 and 19, into the rear third of a piston seal 22 which is located between rotor 12 and inner casing 11 on the opposite side of the inlet from the steam passage 14. After it has left the intermediate space 21, the cooling steam is mixed with the steam from the inlet 15 which has been expanded across the first two thirds of the piston seal 22. Passive protective shields 20 are arranged on the rotor 12 in the last third of the piston seal 22, and although these shields do not keep the abovementioned mixed steam at a high temperature away from the rotor, since this steam can, for example, reach the rotor surface via gaps in the protective shield 20, they do prevent this mixed steam from causing a high relative velocity with respect to the rotor surface and therefore considerable introduction of heat into the rotor.

Figure 2:
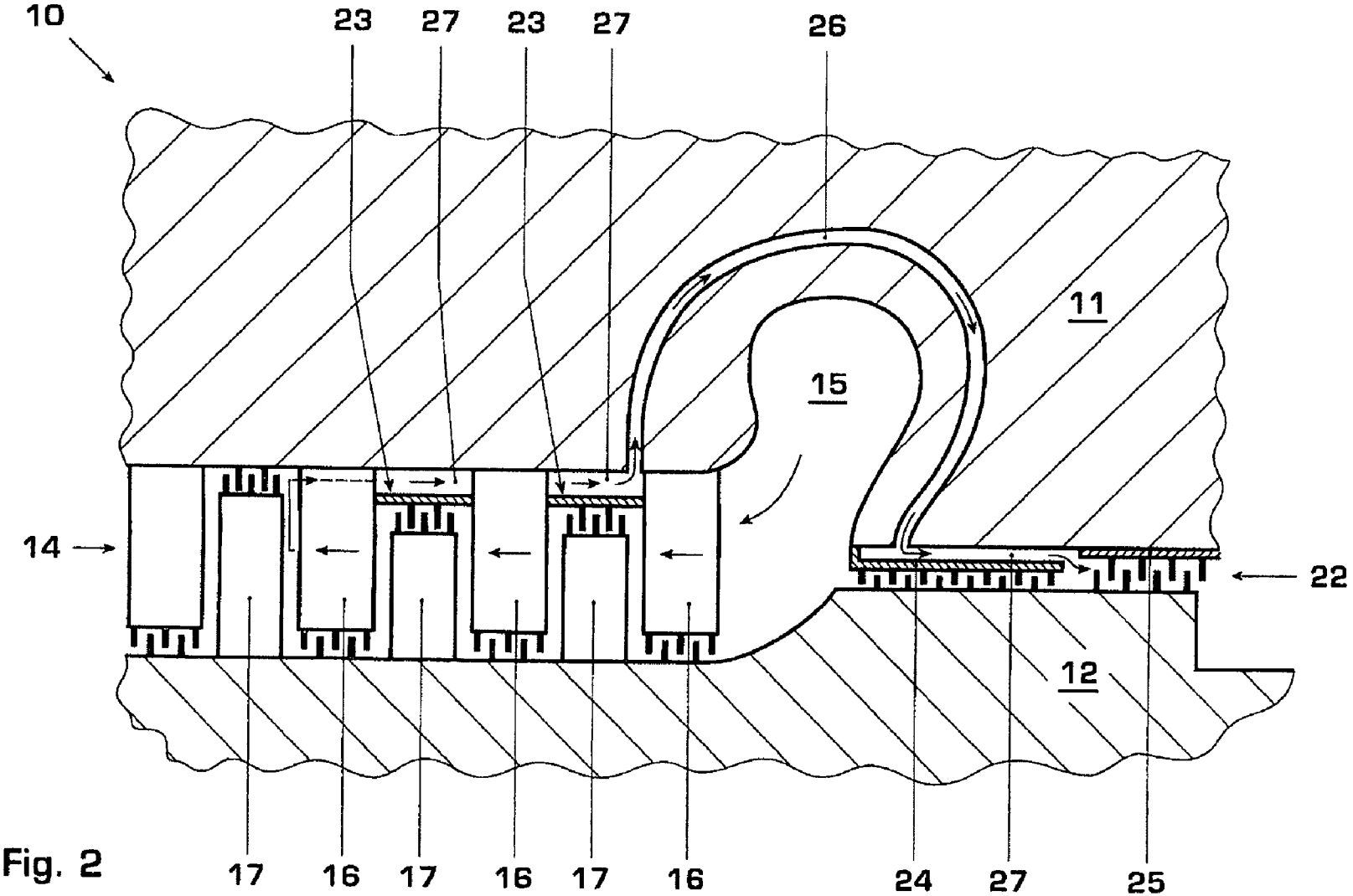
FIG. 2 shows, in an illustration comparable to FIG. 1, a second exemplary embodiment of the invention with actively steam-cooled protective shields for protecting the inner casing.

FIG. 2 shows an illustration similar to that presented in FIG. 1 of a steam turbine 10 in an arrangement in which steam from the third stage of the steam passage 14 (cf. the arrows indicated) is used to cool the inner casing 11. In this case, the cooling steam is passed through an intermediate space 27 which is formed between the inner surface of the inner casing 11 and protective shields 23 arranged at a distance above it in the steam passage and protective shields 24 in the seal or piston seal 22. To guide the cooling steam past the inlet 15 into the piston seal 22, in this case a passage or bore 26 is formed in the inner casing 11. The cooling steam is separated from the hot steam by the protective shields 23 in the steam passage 14 and 24 in the piston seal 22. In the final third of the piston seal 22, the cooling or cool steam is mixed with the sealing steam which arrives from the inlet 15 via the seal 22. Then, inside the seal 22, the inner casing 11 is provided with a passive protective shield 25.

Figure 7:
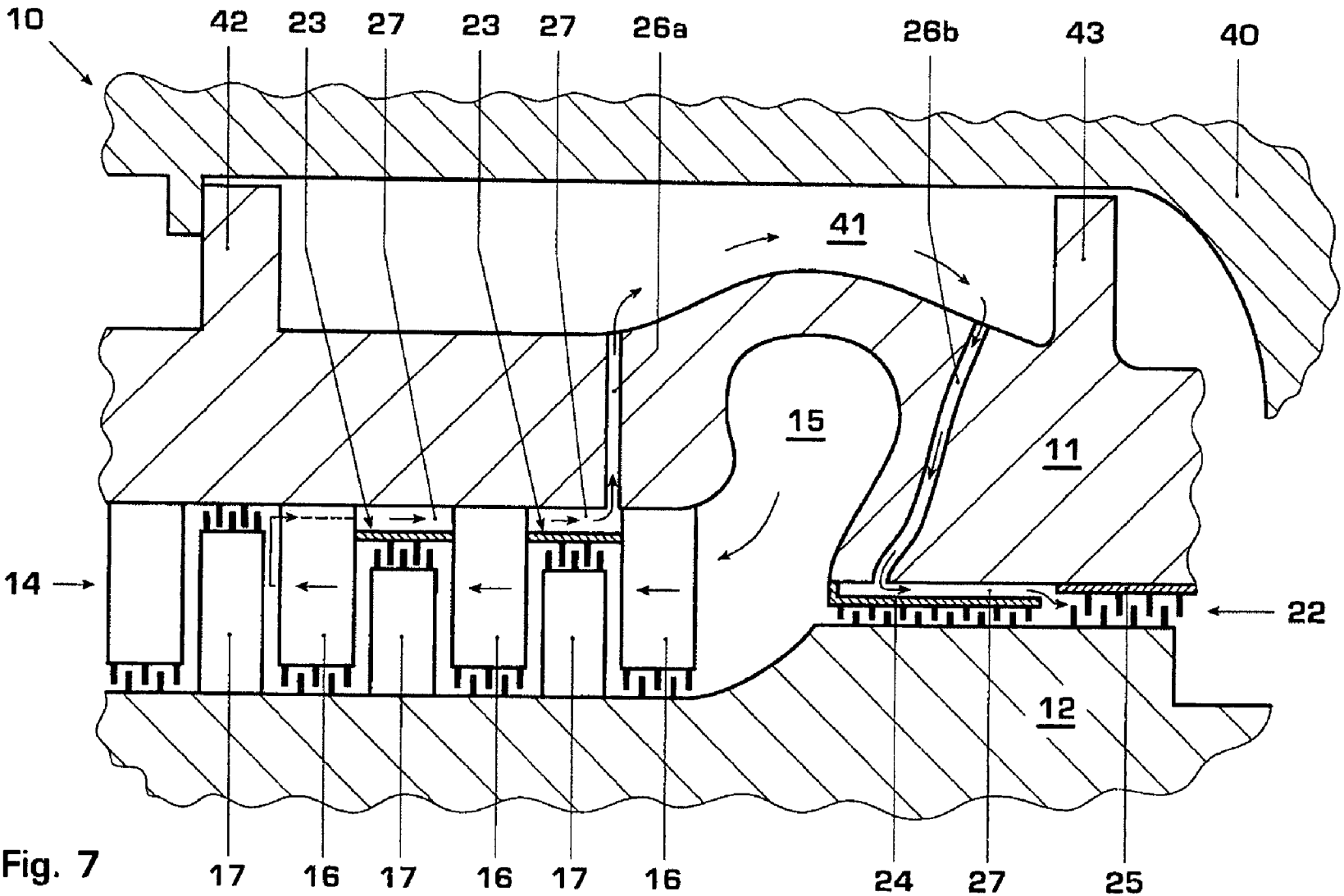
FIG. 7 shows an illustration similar to FIG. 1 of a third exemplary embodiment of the invention, with actively steam-cooled protective shields for protecting the inner casing.

FIG. 7 shows a similar illustration to FIG. 2 of a steam turbine 10 in an arrangement in which an additional intermediate space 41 is created between inner casing 11 and outer casing 40 by sealing members 42, 43. To guide the cooling steam past the inlet 15 into the piston seal 22, in this case two passages 26*a* and 26*b* are arranged in the inner casing. The cooling steam flows out of the intermediate space 27 at the steam passage through the passage 26*a* into the intermediate space 41 and, from there, through the passage 26*b* into the piston seal 22.

Figure 3:
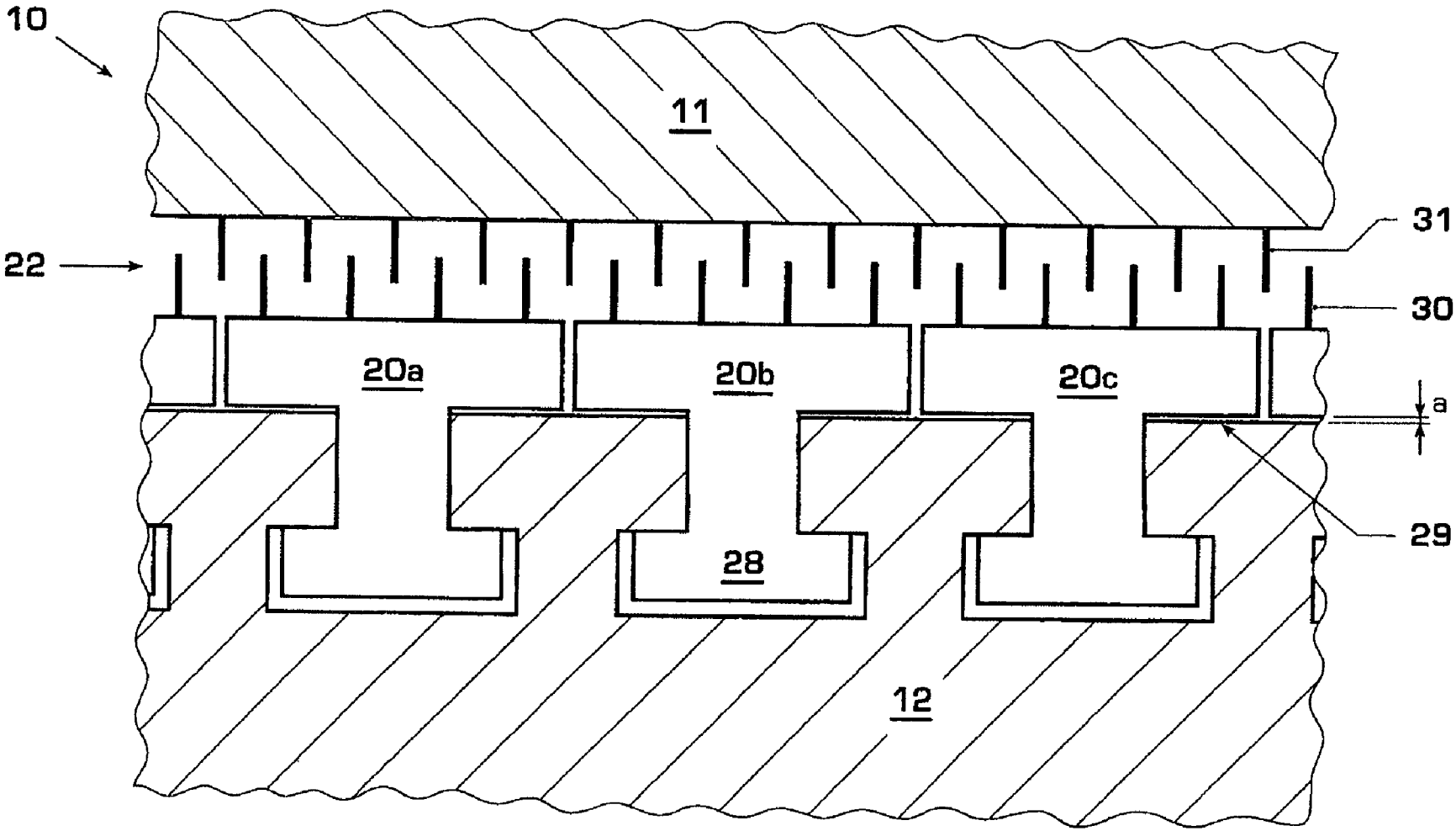
FIG. 3 shows an enlarged excerpt illustrating a preferred exemplary embodiment for "passive" protective shields which are not steam-cooled and are mounted on the rotor in the region of the seal by means of hammerhead-like roots.

FIG. 3 illustrates exemplary embodiments for passive protective shields or plates 20*a*, 20*b* and 20*c* in the piston or shaft seal 22. In this example, the protective shields 20*a*, 20*b*, 20*c*are secured in the rotor 12 by means of hammerhead-like roots 28. A narrow gap 29 of width a may and even should be present between the protective shields 20*a*, 20*b*, 20*c* and the rotor surface, in order to reduce the heat transfer from the protective shields 20*a*, 20*b*, 20*c* to the rotor 12. Sealing strips 30 are arranged on the protective shields 20*a*, 20*b*, 20*c* and together with the sealing strips 31 on the inner casing 11 throttle the steam.

Figure 4:
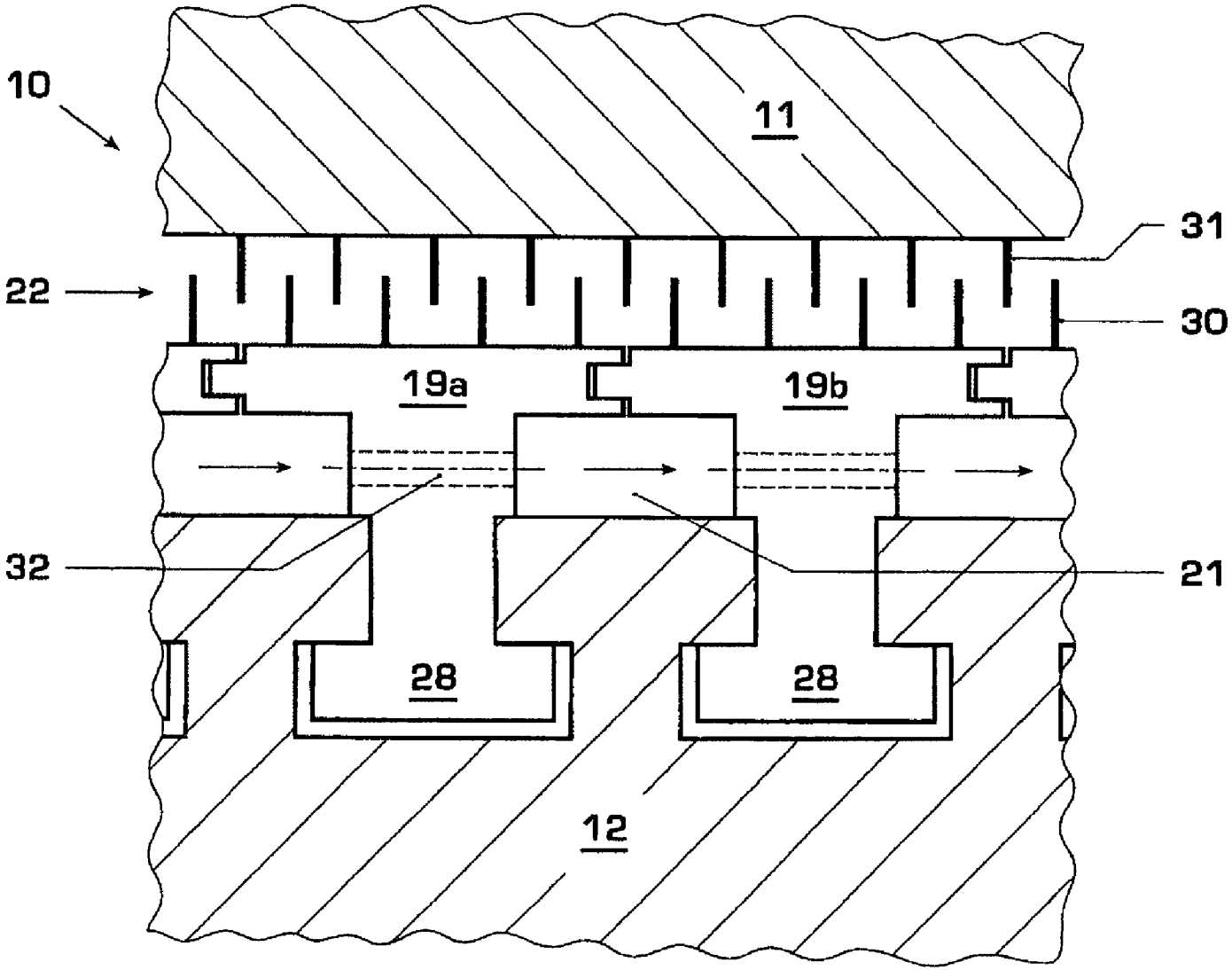
FIG. 4 shows an enlarged excerpt illustrating a preferred exemplary embodiment for actively steam-cooled protective shields which are mounted on the rotor in the region of the seal by means of hammerhead-like roots.

FIG. 4 shows "active" protective shields or plates 19*a*, 19*b*, i.e. protective shields which separate, in a pressure-resistant manner, the flow of steam in the seal 22 from the flow of cooling steam in the intermediate space 21 between protective shields 19*a*, 19*b* and rotor 12. These protective shields 19*a*, 19*b* are located in a piston or shaft seal 22. In this example too, they are secured in the rotor 12 by means of hammerhead-like roots 28. They each have axial bores 32 so that the cooling steam can pass the roots of the protective shields 19*a*, 19*b* without being impeded. In this case too, sealing strips 30, 31 are once again provided alternately between the protective shields 19*a*, 19*b* and the inner casing 11, and the hot steam flows between them.

Figure 5:
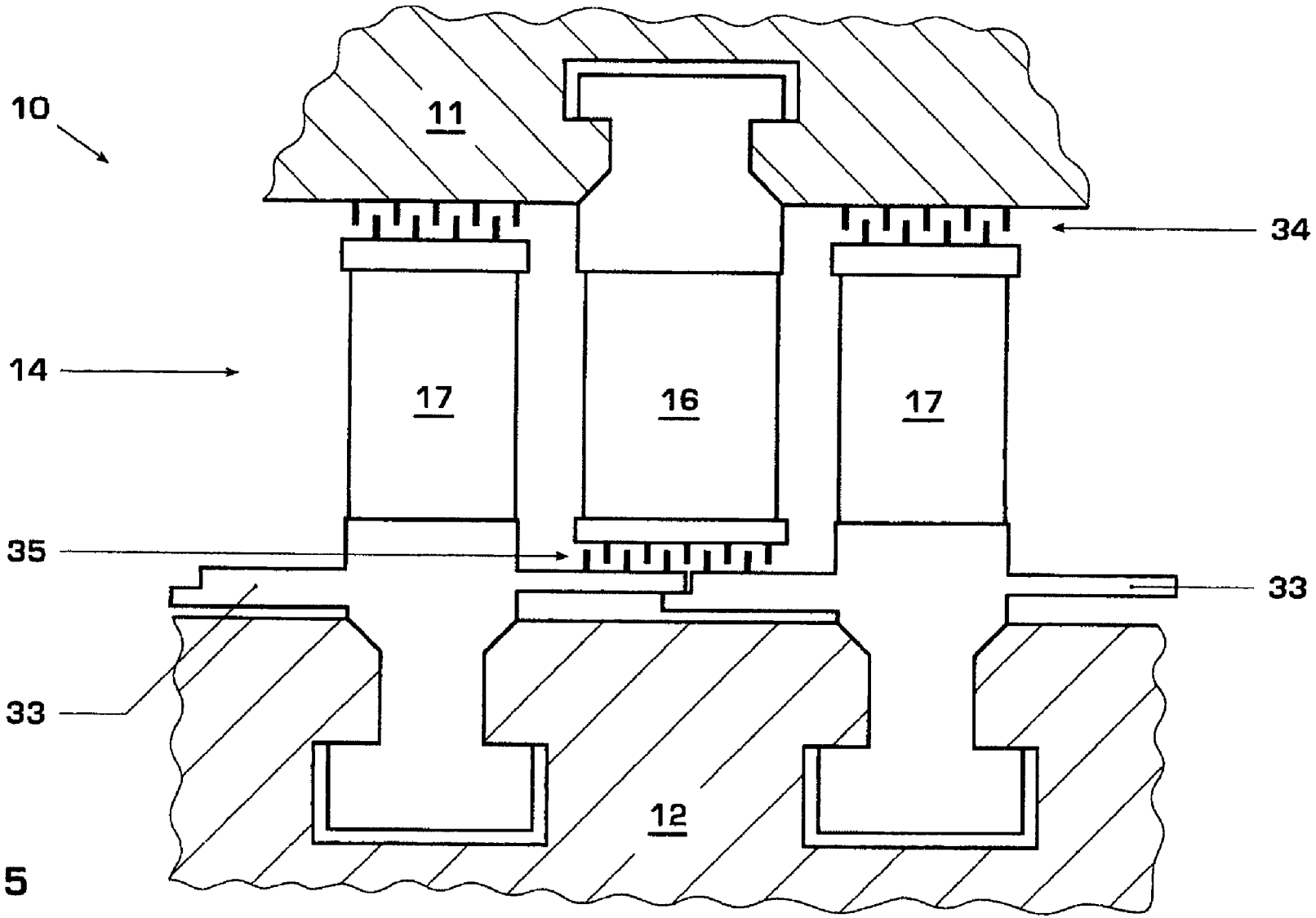
FIG. 5 shows an enlarged excerpt illustrating a preferred exemplary embodiment for "passive" protective shields, which are not steam-cooled, designed as parts of the rotor blades.

FIG. 5 shows protective shields 33 in the steam passage 14, which are part of the rotor blades 17 and may optionally be active or passive protective shields. The protective shields 33 overlap at the edges in order to achieve an increased protection against leaks. On the protective shields there are sealing strips 35 which separate the steam in front of and behind the guide vane 16. Further sealing strips 34 are arranged between rotor blades 17 and the inner casing 11.

Figure 6:
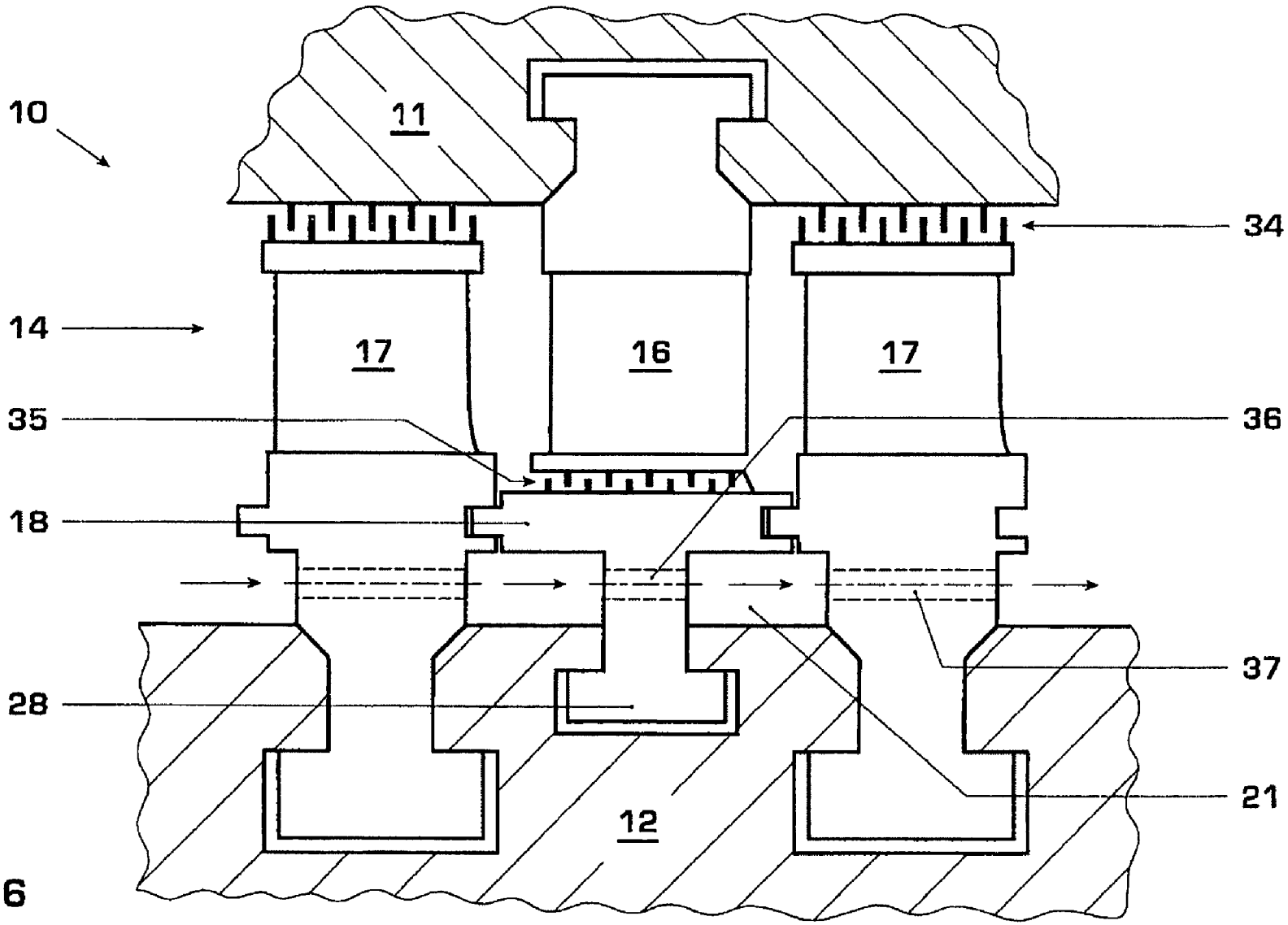
FIG. 6 shows an enlarged excerpt illustrating a preferred exemplary embodiment for actively steam-cooled protective shields which are mounted on the rotor between the rotor blades by means of hammerhead-like roots.

Finally, FIG. 6 shows active protective shields or plates 18 in the steam passage 14, beneath which there are once again intermediate spaces 21 within which the cooling steam flows (cf. the arrows indicated). In this case too, the protective shields 18 are secured to the rotor 12 by means of hammerhead-like roots 28. To pass from one intermediate space 21 to the next, bores 36 are provided in the protective shields 18, and bores 37 are provided in the roots of the rotor blades 17. Between the guide vanes 16 and the protective shields 18 there are sealing strips 35 in order to seal off the pressure drop at the stator. Sealing strips 34 are likewise provided between the inner casing 11 and the rotor blades 17.

LIST OF DESIGNATIONS

10 Steam turbine
11 Inner casing
12 Rotor
13 Axis (turbine)
14 Steam passage
15 Inlet
16 Guide vane
17 Rotor blade
18 Protective shield (active)
19 Protective shield (active)
20 Protective shield (passive)
21 Intermediate space
22 Seal (piston seal)
23 Protective shield (active)
24 Protective shield (active)
25 Protective shield (passive)
26,26*a*,26*b* Bore, passage
27 First intermediate space
28 Root (hammerhead-like)
29 Gap
30,31 Sealing strip
32 Bore
33 Protective shield
34,35 Sealing strip
36,37 Bore
40 Outer casing of the steam turbine
41 Second intermediate space
42 Sealing member
43 Sealing member While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A steam turbine comprising:

an inner casing;

a rotor that can rotate about an axis, arranged within the inner casing;

a steam passage formed between the rotor and the inner casing;

a multi-stage arrangement of guide vanes secured to the inner casing and rotor blades secured to the rotor, the multi-stage arrangement positioned in the steam passage;

a hot steam inlet, wherein when hot steam issues from the inlet, the hot steam undergoes work-performing expansion in said multi-stage arrangement;

plate-like protective shields positioned at least in the steam passage configured and arranged to protect the surface of the rotor or the inner casing beneath said plate-like protective shields from direct action of hot steam when flowing though the steam passage, the plate-like protective shields being arranged parallel and close to the surface of the rotor, parallel and close to the inner surface of the inner casing, or both;

wherein the protective shields are arranged at a distance from a surface to be protected of the rotor, inner casing, or both, to form an intermediate cooling space;

means for permitting cooling steam to flow though the intermediate cooling space;

wherein said protective shields comprise first protective shields arranged in front stages, as seen in the direction of flow, of the steam passage; and means for removing cooling steam from the steam passage in one of the stages located downstream of said first protective shields and for feeding back said removed cooling steam though the intermediate cooling space in the opposite direction to the direction of flow.

2. The steam turbine as claimed in claim 1, wherein said intermediate cooling space is a first intermediate cooling space, and further comprising:

a seal in the region of the inlet and between the rotor and the inner casing on the opposite side from the steam passage;

wherein said protective shields comprise second protective shields arranged in the region of the seal at a distance from a surface of the rotor or inner casing to be protected, so as to form a second intermediate cooling space; and wherein when cooling steam flows though the first intermediate space behind the first protective shields, said cooling steam is then passed though said second intermediate cooling space.

3. The steam turbine as claimed in claim 2, wherein the first and second protective shields are configured and arranged to protect the surface of the rotor; and further comprising:

a common intermediate space continuous though the region of the inlet, behind the first and second protective shields.

4. The steam turbine as claimed in claim 2, wherein the first and second protective shields are configured and arranged to protect the surface of the inner casing, and further comprising:

intermediate spaces behind the first and second protective shields connected to one another.

5. The steam turbine as claimed in claim 4, further comprising:

a passage routed around the region of the inlet in the inner casing and connecting together the intermediate spaces behind the first and second protective shields.

6. The steam turbine as claimed in claim 2, wherein the first and second protective shields are configured and arranged to protect the surface of the inner casing, and further comprising:

an outer casing;

sealing members between the outer casing and the inner casing;

a third intermediate cooling space formed by the inner casing, the outer casing, and the sealing members;

two passages;

wherein the first and second intermediate cooling spaces are connected to one another by said two passages and the third intermediate cooling space; and wherein said two passages and the third intermediate cooling space are routed around the region of the inlet.

7. The steam turbine as claimed in claim 2, wherein the second protective shields extend only over a part of the length of the seal, and wherein the protective shields comprise third protective shields protecting the surface of the rotor or of the inner casing, over the remaining part of the length of the seal.

8. The steam turbine as claimed in claim 7, wherein the second protective shields extend over the first two thirds of the length of the seal.

9. The steam turbine as claimed in claim 2, wherein the seal comprises a piston seal or a casing shaft seal.

10. The steam turbine as claimed in claim 1, configured and arranged for double-flow including a first flow and a second flow, and for passing cooling steam for the first flow into the second flow where said cooling steam opens out into a stage with a lower pressure or into the casing outlet.

11. A steam turbine comprising:

an inner casing;

a rotor that can rotate about an axis, arranged within the inner casing;

a steam passage formed between the rotor and the inner casing;

a multi-stage arrangement of guide vanes secured to the inner casing and rotor blades secured to the rotor, the multi-stage arrangement positioned in the steam passage;

a hot steam inlet, wherein when hot steam issues from the inlet, the hot steam undergoes work-performing expansion in said multi-stage arrangement; and plate-like protective shields positioned at least in the steam passage configured and arranged to protect the surface of the rotor over the entire rotor surface between the rotor blades or the inner casing beneath said plate-like protective shields from direct action of hot steam when flowing though the steam passage, the plate-like protective shields being arranged parallel to and directly on the surface of the rotor over the entire space between the rotor blades, parallel to and directly on the inner surface of the inner casing, or both.

12. The steam turbine as claimed in claim 11, wherein the protective shields comprise a part of the rotor blades secured to the rotor.

13. The steam turbine as claimed in claim 11, further comprising:

sealing members extending radially from the guide vanes toward the plate-like protective shields, from the plate-like protective shields toward the guide vanes, or both.

14. A steam turbine comprising:

an inner casing;

a rotor that can rotate about an axis, arranged within the inner casing;

a steam passage formed between the rotor and the inner casing;

a multi-stage arrangement of guide vanes secured to the inner casing and rotor blades secured to the rotor, the multi-stage arrangement positioned in the steam passage;

a hot steam inlet, wherein when hot steam issues from the inlet, the hot steam undergoes work-performing expansion in said multi-stage arrangement;

plate-like protective shields positioned at least in the steam passage configured and arranged to protect the surface of the rotor or the inner casing beneath said plate-like protective shields from direct action of hot steam when flowing though the steam passage, the plate-like protective shields being arranged parallel and close to the surface of the rotor, parallel and close to the inner surface of the inner casing, or both, said plate-like protective shields being separate from said guide vanes and rotor blades;

an unobstructed shaft seal between the rotor and the inner casing; and wherein the shields comprise at least one shield positioned in the shaft seal with a narrow gap between the at least one shield and the rotor, the inner casing, or both, the narrow gap configured and arranged to reduce heat transfer from the at least one shield to the rotor, to the inner casing, or to both.

15. A steam turbine comprising:

an inner casing;

a rotor that can rotate about an axis, arranged within the inner casing;

a steam passage formed between the rotor and the inner casing;

a multi-stage arrangement of guide vanes secured to the inner casing and rotor blades secured to the rotor, the multi-stage arrangement positioned in the steam passage;

a hot steam inlet, wherein when hot steam issues from the inlet, the hot steam undergoes work-performing expansion in said multi-stage arrangement;

plate-like protective shields positioned at least in the steam passage configured and arranged to protect the surface of the rotor or the inner casing beneath said plate-like protective shields from direct action of hot steam when flowing though the steam passage, the plate-like protective shields being arranged parallel and close to the surface of the rotor, parallel and close to the inner surface of the inner casing, or both, said plate-like protective shields being separate from said guide vanes and rotor blades;

a shaft seal between the rotor and the inner casing; and wherein the shields comprise at least one shield positioned in the shaft seal and including an axial bore for cooling steam to pass though.

16. A steam turbine comprising:

an inner casing;

a rotor that can rotate about an axis, arranged within the inner casing;

a steam passage formed between the rotor and the inner casing;

a multi-stage arrangement of guide vanes secured to the inner casing and rotor blades secured to the rotor, the multi-stage arrangement positioned in the steam passage;

a hot steam inlet, wherein when hot steam issues from the inlet, the hot steam undergoes work-performing expansion in said multi-stage arrangement;

plate-like protective shields positioned at least in the steam passage configured and arranged to protect the surface of the rotor or the inner casing beneath said plate-like protective shields from direct action of hot steam when flowing though the steam passage, the plate-like protective shields being arranged parallel and close to the surface of the rotor, parallel and close to the inner surface of the inner casing, or both, said plate-like protective shields being separate from said guide vanes and rotor blades;

an intermediate space between the shields and the rotor, between the shields and the inner casing, or both, allowing cooling steam to pass.

17. A steam turbine comprising:

an inner casing;

a rotor that can rotate about an axis, arranged within the inner casing;

a steam passage formed between the rotor and the inner casing;

a multi-stage arrangement of guide vanes secured to the inner casing and rotor blades secured to the rotor, the multi-stage arrangement positioned in the steam passage;

a hot steam inlet, wherein when hot steam issues from the inlet, the hot steam undergoes work-performing expansion in said multi-stage arrangement;

plate-like protective shields positioned at least in the steam passage configured and arranged to protect the surface of the rotor over the entire rotor surface between the rotor blades or the inner casing beneath said plate-like protective shields from direct action of hot steam when flowing though the steam passage, the plate-like protective shields being arranged parallel to and close to the surface of the rotor over the entire space between the rotor blades, parallel to and close to the inner surface of the inner casing, or both, the plate-like protective shields comprising a part of the rotor blades secured to the rotor; and wherein the shields comprise at least one shield positioned with a narrow gap between the at least one shield and the rotor, the inner casing, or both, the narrow gap configured and arranged to reduce heat transfer from the at least one shield to the rotor, to the inner casing, or to both.

18.

A steam turbine comprising:

an inner casing;

a rotor that can rotate about an axis, arranged within the inner casing;

a steam passage formed between the rotor and the inner casing;

a multi-stage arrangement of guide vanes secured to the inner casing and rotor blades secured to the rotor, the multi-stage arrangement positioned in the steam passage;

a hot steam inlet, wherein when hot steam issues from the inlet, the hot steam undergoes work-performing expansion in said multi-stage arrangement;

plate-like protective shields positioned at least in the steam passage configured and arranged to protect the surface of the rotor beneath said plate-like protective shields from direct action of hot steam when flowing though the steam passage, the plate-like protective shields being arranged parallel and close to the surface of the rotor, said plate-like protective shields being separate from said guide vanes and rotor blades;

a shaft seal between the rotor and the inner casing; and wherein the shields comprise at least one shield positioned in the shaft seal with a narrow gap between the at least one shield and the rotor, the narrow gap configured and arranged to reduce heat transfer from the at least one shield to the rotor.

* * * * *